United States Patent [19]

Jensen et al.

[11] 4,009,048

[45] Feb. 22, 1977

[54] SOLVENT CLEANING AND RECOVERY PROCESS

[75] Inventors: Bruce E. Jensen, Pensacola; Jimmie G. Tolar, Milton, both of Fla.

[73] Assignee: Air Products and Chemicals, Inc., Allentown, Pa.

[22] Filed: July 11, 1975

[21] Appl. No.: 595,134

[52] U.S. Cl. ..... 134/12; 134/13; 134/22 R; 134/38; 203/47; 203/48; 210/42 R

[51] Int. Cl.[2] ..... B08B 3/08; B08B 3/10

[58] Field of Search ..... 134/10, 12, 13, 22 R, 134/22 C, 38, 37; 260/92.8 A; 210/42, 56; 264/39; 203/47, 48

[56] References Cited

UNITED STATES PATENTS

| | | | |
|---|---|---|---|
| 2,389,958 | 11/1945 | Crawford et al. | 210/56 X |
| 3,764,384 | 10/1973 | Berni | 134/13 X |
| 3,862,103 | 1/1975 | Campbell et al. | 260/92.8 A X |
| R27,432 | 7/1972 | Torrenzano et al. | 134/12 |

*Primary Examiner*—S. Leon Bashore
*Assistant Examiner*—Marc L. Caroff
*Attorney, Agent, or Firm*—Richard A. Dannells; Barry Moyerman

[57] ABSTRACT

Vinyl halide polymers are removed from the internal surfaces of reaction equipment with a solvent and the solvent recovered by: (1) contacting the polymer-containing solvent with steam forming a slurry; (2) cooling the slurry to form a crumbly precipitate; (3) separating the resulting slurry into an aqueous solvent and a precipitate; (4) adding water to the precipitate to form a second slurry; and (5) separating the second slurry into a second aqueous solvent solution and vinyl halide polymers. The aqueous solvent solutions are dehydrated before being reused in solvent cleaning.

17 Claims, 1 Drawing Figure

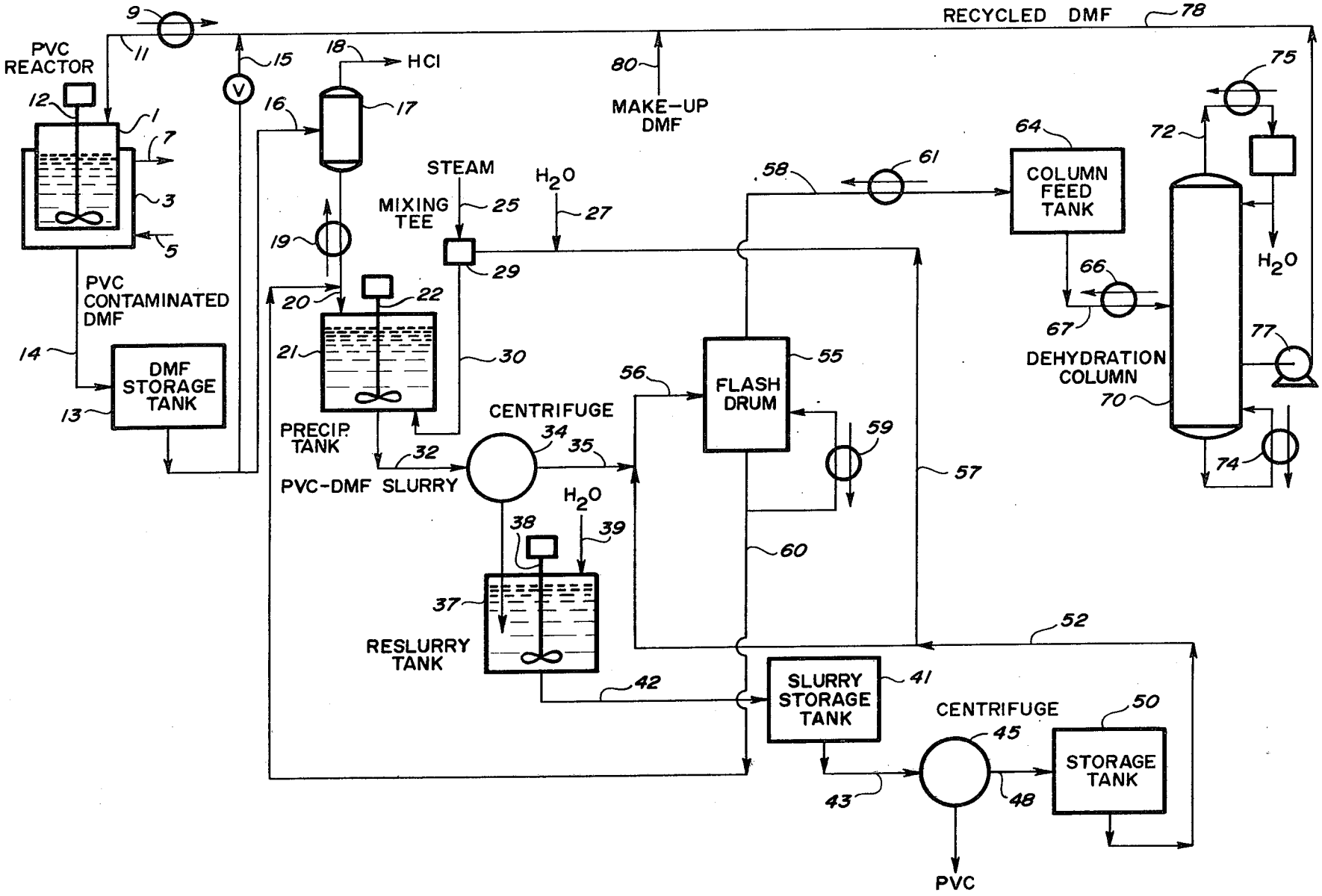
RECYCLED DMF
78
75
$H_2O$
77
74
72
COLUMN FEED TANK
64
66
67
DEHYDRATION COLUMN
70
52
STORAGE TANK
50
CENTRIFUGE
45
48
PVC
57
61
59
55
FLASH DRUM
60
SLURRY STORAGE TANK
41
43
58
MAKE-UP DMF
80
56
42
$H_2O$
27
CENTRIFUGE
34
35
$H_2O$
39
38
STEAM
25
29
30
MIXING TEE
22
32
SLURRY
37
RESLURRY TANK
HCl
17
18
19
20
21
PRECIP. TANK
PVC-DMF
15
16
9
11
1
7
3
5
PVC REACTOR
12
PVC CONTAMINATED DMF
14
DMF STORAGE TANK
13

SOLVENT CLEANING AND RECOVERY PROCESS

BACKGROUND OF THE INVENTION

1. Field of the Invention

This invention is directed to a process for solvent cleaning the internal surfaces of polyvinyl halide reactors and for recovering the solvent used therein for reuse in the cleaning step.

Manual cleaning of the polymerization reaction equipment can be eliminated by practicing this invention. This has particular importance in light of the harmful nature of the vinyl halides such as vinyl chloride used in the polymerization reaction and the recent governmental regulations concerning the exposure of personnel to vinyl chloride.

2. Description of the Prior Art

There are at least two known methods for chemically removing vinyl halide polymeric residues adhering to the internal surfaces of the polymerization equipment and for recovering the solvent for reuse.

One such process is disclosed in Torrenzano et al, U.S. Pat. Re, 27,432. The essential features of the Torrenzano process comprises contacting the residual build up of polymeric materials from vinyl halide polymerization vessels with a solvent such as tetrahydrofuran (THF) which has an atmospheric boiling point of 66° C, and then contacting the solution with the polymers dissolved therein with steam to flash distill the THF for its recovery and reuse. The residual materials such as water, some THF and precipitated polymers are discarded as waste. This process requires the use of solvents that have boiling points below that of water or that form an azeotrope that has a boiling point below that of water.

Another prior art solvent cleaning and recovery process is disclosed in Berni, U.S. Pat. No. 3,764,384. The Berni process comprises contacting the build up of polyvinyl halide on the surfaces of the polymerization equipment with N-methyl pyrrolidone, adding 20 to 50% by volume of water to the residue-solvent solution to precipitate the polymeric residues and separating the precipitate from the aqueous N-methyl pyrrolidone solution by either filtration or centrifugation. The latter is dehydrated for reuse and the polymeric precipitate is incinerated or otherwise discarded. The disadvantages of this process are that it loses too much water and solvent and a precipitate is formed in the process that is not easily separated from the solvent.

SUMMARY OF THE PRESENT INVENTION

In contrast to the prior art methods, the present invention provides a process for the solvent cleaning of residual vinyl halide polymers from reactor internal and the subsequent recovery of the solvent with minimal losses. An additional advantage of the process is that a precipitate is formed during the process which is easily removed from the solvent. Accordingly, in a process comprising contacting the internal surfaces of polymerization reaction equipment with a solvent for vinyl halide polymers heated to an elevated temperature, e.g. in the range of about 70° to 150° C, and recovering a solution containing the vinyl halide polymers dissolved in the solvent, the improvement comprises the steps of: (1) contacting the polymer-containing solution with steam in a vessel to precipitate substantially all of the vinyl halide polymers from the solution; (2) separating the resulting slurry from step (1) into an aqueous solvent containing a majority of the solvent and water originally in the slurry and a precipitate containing substantially all of the polymers and a minor portion of the solvent contained in the slurry; (3) adding water to the precipitate from step (2) with agitation to form a second slurry; and (4) separating the second slurry into a second aqueous solvent solution and vinyl halide polymers.

Each of the aqueous solvent solutions is dehydrated to recover the solvent for reuse in solvent cleaning.

Vinyl halide homopolymers and copolymers of any monomer which can be copolymerized with vinyl halide fall within the definition of vinly halide polymers as used herein. Such monomers include vinyl acetate; vinyl laurate; alkyl acrylates; alkyl methacrylates: alkyl maleates: alkyl fumarates; vinylidene chloride; acrylonitrile; vinyl alkyl ethers such as vinyl acetyl ether, vinyl lauryl ether, and vinyl myristyl ether; olefins such as ethylene, propylene and 1-butene; and the like. Embraced within the definition of vinyl halide polymers are graft copolymers in which such materials as polyethylene, copolymers of ethylene, vinyl acetate and the like are grafted onto the polyvinyl halide backbone.

It is critical to the process of this invention that the solvent used to dissolve the polyvinyl halide resin from the polymerization equipment must not become vaporized in the presence of steam at atmospheric conditions. In other words, the solvent must have an atmospheric boiling point above 100° C, i.e. at least 105° C. Examples of suitable solvents include tetramethyl urea, dimethylacetamide, N-methylpyrrolidone, dimethyl formamide, and diethyl formamide. A particularly effective solvent employed in the present process is dimethyl formamide (DMF).

A number of variables must be controlled during the steam precipitation step (step 1) to assure effective and complete separation of the precipitate and the aqueous solution during step (2). The variables include control of the temperature, water content, and speed of agitation. The temperature within the vessel is increased during step (1) to within the range of about 75° to 120° C. This can usually be accomplished by controlling the amount of steam that is added during this step (1). However, it is contemplated that an external heat source can be used if necessary.

The water content of the vinyl halide polymer-containing solution is increased during step (1) by this addition of steam within the range of about 8 to 18% by weight. The solution from the polymerization equipment inherently contains about 3 to 5% by weight water so that the water content can be increased to the desired range by the addition of steam. In certain instances it is desired to entrain from 0.1 to 60% by weight water in the steam and to use the wet steam to obtain the optimum water content during this step. The water necessary to produce the wet steam can be obtained from the aqueous solvent solution separated from the vinyl halide polymer in step (4) and thus to reduce the amount of water that must be removed in the dehydration of the solvent.

The contents of the precipitation vessel should be agitated until the resulting slurry comprising the polymeric residue suspended in the aqueous solvent solution is processed during step (2). To immediately separate the precipitate by filtration or centrifugation while the slurry is too hot results in a polymeric cake which is rubbery and is difficult to process. It has been found that an excellent crumbly polymeric cake is produced which is easily removed from the aqueous solvent solution if the slurry is cooled to less than the highest temperature obtained during the precipitation step, e.g. less than 75° C, and preferably to a temperature in the range of about 30° to 65° C.

A BRIEF DESCRIPTION OF THE DRAWING

The drawing is a process flow diagram of a preferred embodiment of the present invention in which a polyvinyl chloride (PVC) reactor is chemically cleaned with DMF and the recovered DMF is recycled to the reactor.

DESCRIPTION OF THE PREFERRED EMBODIMENT OF THIS INVENTION

Referring now to the drawing, PVC reactor 1 is shown equipped with a heating and cooling jacket 3 having inlet 5 and outlet 7 for the heating or cooling media. Reactor 1 is employed in the manufacture of vinyl chloride homopolymers and copolymers until the residual polymer buildup on the internal surfaces of the reactor is too thick to allow adequate heat transfer, or until contamination from the residue results in polymer quality problems in future batches, or until the type of polymer being manufactured in the reactor is changed. DMF solvent which has been preheated in heat exchanger 9 to a temperature in the range of approximately 80° to 100° C is then introduced into reactor 1 through line 11. After the reactor is filled with preheated DMF solvent, it is agitated by means of agitator 12 while maintaining the contents in the range of about 80° to 100° C until the PVC buildup has been dissolved in the solvent. The PVC-contaminated DMF is passed to DMF storage tank 13 via line 14. DMF in tank 13 can be passed through line 15, the valve and line 11 and reused to clean the PVC reactor a number of times. When the batch of solvent has become spent or when the solvent contains up to about 5% by weight of polymer, the valve is closed and the PVC-contaminated DMF in storage tank 13 is passed via line 16 to vacuum stripper 17. This step is optional and is designed to remove trace amounts of hydrochloric acid (HCl) via line 18, which would otherwise cause corrosion in the solvent recovery equipment.

The PVC-contaminated DMF solution containing about 3% by weight of water is preheated to a temperature in the range of about 40° to 70° C in heat exchanger 19 and passed via line 20 into precipitation tank 21 equipped with agitator 22. Wet steam having a pressure of at least about 50 psig is produced from steam in line 25 and water in line 27 by means of mixing tee 29 and is introduced into the bottom of precipitation tank 21 via line 30 until the resulting slurry produced by the precipitation of the PVC resin contains water in the range of about 9 to 12% by weight of water. Alternatively, the wet steam may be produced by passing the steam through a heat exchanger (not shown) to produce partial condensation. Substantially all of the PVC has precipitated out of solution as discrete particles when the water content of the slurry is within the above range. The resulting slurry is then cooled to approximately 55° C under ambient conditions and passed via line 32 into centrifuge 34 to separate out with ease the precipitated PVC polymeric solids from the aqueous solvent solution. Alternatively, a filter may be used in place of the centrifuge. One may cool the slurry in tank 21 by means not shown such as with a cooling coil or jacket. The aqueous solvent solution from centrifuge 34 is passed through line 35 for further processing. The resulting friable, spongy solids from centrifuge 34 are discharged by gravity directly into reslurry tank 37 equipped with agitator 38. The solids are combined with water passing through line 39 in reslurry tank 37 with agitation. The resulting slurry should contain water and solids in the weight ratio of 1:1 to 6:1. It is then passed to slurry storage tank 41 via line 42. The slurry in tank 41 is continuously or intermittently passed via line 43 to centrifuge 45 to separate out the PVC polymeric solids. The polymeric residue is discarded in a convenient vessel (not shown) and the liquid effluent is passed via line 48 to storage tank 50. The effluent is passed from tank 50 via line 52, combined with the solution from centrifuge 34 in line 35 and passed to flash drum 55 via line 56. A portion of the solution from storage tank 50 may be passed through line 57 and combined with steam to produce wet steam in mixing tee 29. This reduces the amount of water added to the system and hence reduces the load on the downstream solvent recovery facilities. The volatiles in flash drum 55 are flashed overhead through line 58 by means of the heat supplied by reboiler 59. The nonvolatile polymeric resin is purged from flash drum 55 as a concentrated solution via line 60 and returned to precipitation tank 21. Alternatively, the PVC slurry can be recycled through the tubes of reboiler 59. After the PVC builds up on the tube walls, the slurry is diverted to another reboiler (not shown) so that reboiler 59 can be cleaned free of PVC. The volatiles from flash drum 55 containing water vapor and substantially all of the DMF are condensed in condenser 61 and the condensed liquid is passed via line 58 into dehydration column feed tank 64. The aqueous DMF solution in the tank 64 is heated in heat exchanger 66 and passed via line 67 to dehydration column 70 in which water is boiled overhead via line 72 by means of the heat supplied by reboiler 74. The water vapor is condensed in condenser 75. The DMF is recovered as a side cut from column 70 and is pumped by means of pump 77 via line 78 to be used in the solvent cleaning of reactor 1. Make-up solvent may be added if necessary via line 80.

The following examples are designed to further illustrate the preferred embodiment of the present invention:

Example 1

Precipitation and First Separation Steps

About 1700 liters (450 gallons) of the PVC-contaminated solution in line 20 containing approximately 2% by weight of PVC, 4% by weight of water and 94% by weight of DMF were heated to 55° C. The heated solution was then introduced into precipitation tank 21 and was agitated at 430 revolutions per min. (RPM) during the entire precipitation step. Wet steam in line 30 was purged into precipitation tank 21 until 11.4% by weight of water had been introduced and the temperature of the resulting slurry had increased to 90° C. The wet steam was produced by passing saturated steam at 100 psig through the tubes of a heat exchanger (not shown in drawing) at 120 kg./hr. (265 lbs./hr.) with 0.94 l./min. (0.25 gal./min.) of cooling water flowing through the shell side of the heat exchanger. Water was sprayed onto the exterior of tank 21 to cool the slurry to 32° C. The resulting cooled PVC-DMF slurry was fed at a feed rate of 33.8 l./min. (9 gal./min.) via line 32 to centrifuge 34, which in this example was a 46 cm. (18 in.) by 71 cm. (28 in.) solid bowl centrifuge operating at 1800 RPM. The precipitated solids from centrifuge 34 had a porous, crumbly appearance and were easily separated from the aqueous DMF solution in this first separation step. These solids comprised 7% by weight of water, 54.5% by weight of DMF and 38.5% by weight of PVC and the aqueous DMF solution contained approximately 0.2% by weight of PVC.

Second Separation Step

Using substantially the same precipitation and first separation steps as described in the foregoing paragraph, 14.5 kg. of solids from centrifuge 34 were obtained which contained 12% by weight of water, 58% by weight of DMF and 30% by weight of PVC. The solids were added to reslurry tank 37 containing 568 liters (150 gal.) of water over a ten minute period with agitation provided by agitator 38 operating at 430 RPM. The weight ratio of water to solids after this addition was 3.9 to 1. After agitating the resulting slurry for an additional 10 minutes, it was fed via lines 42 and 43 into centrifuge 45. The centrifuge used in this second separation step was the same centrifuge that was used in the first separtion step described above and was also spun at 1800 RPM. The liquid effluent in line 48 from centrifuge 45 contained 12.3% by weight of DMF and 87.7% by weight of water. The solids from centrifuge 45 contained 53.7% by weight of PVC, 37.3% by weight of water and only 9.0% by weight of DMF. In other words, 91.3% by weight of the DMF in the solids from centrifuge 34 was recovered during this second separation step. This represents approximately 99.7% by weight total recovery of the DMF that was originally in the PVC-contaminated solution fed to tank 21.

EXAMPLE 2

The procedure and results set forth under Example 1 were used as the basis for this example in which a typical PVC-contaminated solution containing 3.5 parts by weight (pbw) of PVC, 5.6 pbw of water and 90.9 pbw of DMF is subjected to the process of this invention. Wet steam containing 30 pbw of water is combined with the solution in precipitation tank 21 until 4.9 pbw of water is introduced. The effluent from the first separation step contains 97.9 pbw of an aqueous DMF solution comprising 10% by weight water. The solids from this step comprises 3.5 pbw of PVC, 0.36 pbw of water and 3.14 pbw of DMF. The solids are combined with 14 pbw of water so that the resulting slurry has a weight ratio of 2 parts of water to 1 part solids. The effluent from the second separation step cotains 12.8% by weight of DMF and the solids contain 3.5 pbw of PVC, 2.6 pbw of water, and 0.53 pbw of DMF. The total DMF solvent recovery is calculated to be approximately 99.4% by weight.

EXAMPLE 3

Three hundred ml. (285 gms.) of a PVC-contaminated DMF solution containing 3.57% by weight PVC, 1.41% by weight water and 95% by weight of DMF were vigorously stirred in a 500 ml. beaker using a magnetic stirrer. Steam was added to this solution until the temperature had reached 94° C. The amount of water added in this manner was calculated to be 23.5 gms. for a total water concentration in the resulting slurry of about 9% by weight. The slurry was cooled with stirring to 50° C. The cooled slurry was filtered under 71 cm. (28 in.) of vacuum by means of a Buchner funnel with Eaton-Dikeman grade 617 filter paper. The total filtration time was 0.15 minutes. The filter cake was thick and crumbly resulting in a very easy removal from the filter paper. The cake was also in a condition to be easily dispersed in water for the second separation of the type described above. The 31.3 gms. of filter cake were analyzed to contain 30.7% by weight of PVC. The 277.2 gms. of filtrate were analyzed to contain 9.2% by weight of water. The amount of DMF in the filtrate was calculated to be 251.1 gms.

CONTROL 94.9 gms. of a PVC-contaminated DMF solution having substantially the same concentration for each of the PVC, $H_2O$ and DMF components as in Example 3 were vigorously stirred in a 150 ml. beaker using the same agitator as in Example 3. 10.5 gms. of water were then added to this solution. The resulting slurry was 33° C and was stirrred for an additional 2 minutes. The slurry was filtered in the same manner as in Example 3. The total filtration time was 2.0 minutes which is greater than a 10-fold increase over the filtration time of Example 3. The filter cake was matted and not easily removed from the filter paper. Because of the condition of the filter cake, subsequent extraction of DMF would be difficult. The PVC concentration of the filter cake was analyzed with some difficulty to be about 43% by weight. From this analysis, the total recovery of DMF by this method was estimated to be about 95% by weight.

EXAMPLE 4

This example illustrates the effect the water content of the slurry during the precipitation step has on the quality of the filter cake. The procedures of Example 3 were followed in this example except that the final water content after steam addition was varied and is set forth in Table I below:

TABLE 1

| Wt. % $H_2O$ | Quality of Filter Cake | Ease of Separation |
|---|---|---|
| 5.5 | No Precipitation | None |
| 8.2 | 0.38" Thick, Large Particles | Good |
| 9.6 | 0.38" Thick, Large Particles | Good |
| 10.0 | 0.44" Thick, Large Particles | Excellent |
| 12.1 | 0.44" Thick, Large Particles | Excellent |
| 17.5 | 0.5 " Thick, Large Particles | Excellent |

The data indicates that greater than about 6% by weight water should be present in the slurry to permit separation and that the preferred range is 8 to 18% by weight water. An amount of water greater than 18% has no further beneficial effect and merely adds to the load on the dehydration column.

EXAMPLE 5

The effect of agitation is shown in this example in which the procedures of Example 3 were followed except that the water content of the slurry and the agitation speed were varied as set forth in Table II. In this example, the slurry was agitated by means of a 3-blade mixer having 3.8 cm. (1½ inches) diameter blades. The results indicate the importance of providing sufficient agitation to produce a slurry containing discrete, easily separable particles of the precipitated solids. The agitation of the slurry was increased to such an extent during this example that the particles were sheared into smaller particles. This had a detrimental effect on the ease of separation as illustrated in the data presented in Table II below:

TABLE II

| Agitator Speed, RPM | Wt. % $H_2O$ | Quality of Filter Cake | Ease of Separation |
|---|---|---|---|
| 310 | 10.7 | 0.5 " Thick, Large Particles | Excellent |
| 310 | 13.2 | 0.5 " Thick, Large Particles | Excellent |
| 655 | 15.8 | 0.38" Thick, Large Particles | Good |
| 925 | 8.2 | 0.31" Thick, Small Particles | Fair |
| 925 | 12.2 | 0.31" Thick, Small Particles | Fair |

We claim:

1. In a process for solvent cleaning polymerization reaction equipment to remove vinyl halide polymers from the internal surfaces thereof which comprises contacting said internal surfaces with a solvent for said vinyl halide polymers heated to an elevated temperature, said solvent having an atmospheric boiling point above 100° C, and removing a solution containing the vinyl halide polymers dissolved in said solvent from said reaction equipment, the improvement which comprises the steps of:

1. contacting said solution with steam in a vessel to precipitate substantially all of the vinyl halide polymers from said solution to form a first slurry comprising said vinyl halide polymers in an aqueous solution of said solvent and water, said first slurry containing greater than about 6% by weight water and having a temperature within the range of about 75° to 120° C.
2. cooling said first slurry from step (1) to a temperature less than the highest temperature obtained during step (1) sufficient to form a crumbly precipitate,
3. separating the cooled first slurry from step (2) into a first aqueous solvent solution and a precipitate,
4. adding water to said precipitate from step (3) with agitation to form a second slurry,
5. separating said second slurry into a second aqueous solvent solution and vinyl halide polymers, and
6. dehydrating at least one of said aqueous solvent solutions to recover said solvent.

2. The process of claim 1 wherein said solvent is selected from the group consisting of tetramethyl urea, dimethylacetamide, N-methylpyrrolidone, dimethyl formamide, and diethyl formamide, and wherein the temperature during step (1) is increased to within the range of about 75° to 120° C.

3. The process of claim 2 wherein said first slurry from step (1) is cooled to a temperature of less than 75° C before it is separated into said first aqueous solvent solution and said precipitate in step (3).

4. The process of claim 3 wherein said first slurry from step (1) is cooled to a temperature in the range of 30° to 65° C.

5. The process of claim 1 wherein sufficient steam is added during step (1) so that the water content within said vessel is increased to within the range of about 8 to 18% by weight.

6. The process of claim 1 wherein the contents of the vessel is agitated throughout step (1).

7. The process of claim 1 wherein said steam contains 0.1 to 60% by weight of entrained water.

8. The process of claim 1 wherein said vinyl halide polymers are vinyl chloride polymers and said solution containing the vinyl chloride polymers is stripped to remove any hydrochloric acid contained therein prior to step (1).

9. The process of claim 1 wherein each of said aqueous solvent solutions is dehydrated and wherein the resulting dehydrated solvent is recovered for reuse in solvent cleaning.

10. The process of claim 9 wherein each of said aqueous solvent solutions is combined and fractionally distilled to remove substantially all of the water contained in the combined stream.

11. The process of claim 1 wherein said solvent is dimethyl formamide.

12. The process of claim 1 wherein an amount of water is added during step (4) so that said second slurry has a water to precipitate weight ratio of 1:1 to 6:1.

13. In a process for solvent cleaning polymerization reaction equipment to remove vinyl halide polymers from the internal surfaces thereof which comprises contacting said internal surfaces with a solvent for said vinyl halide polymers selected from the group consisting of tetramethyl urea, dimethylacetamide, N-methylpyrrolidone, dimethyl formamide, and diethyl formamide, heated to a temperature in the range of from about 70° to 150° C, said solvent having an atmospheric boiling point about 100° C and removing a solution containing the vinyl halide polymers dissolved in said solvent from said reaction equipment, the improvement which comprises the steps of:

1. contacting said solution with steam in a vessel until the temperature within said vessel is in the range of about 75° to 120° C and the water content is in the range of about 8 to 18% by weight to precipitate substantially all of the vinyl halide polymers from said solution, and to form a first slurry comprising said vinyl halide polymers in an aqueous solution of said solvent and water,
2. cooling said first slurry to a temperature of less than 75° C to form a a crumbly precipitate,
3. separating the cooled first slurry from step (2) into a first aqueous solvent solution and a precipitate,
4. adding water to said precipitate from step (3) with agitation to form a second slurry,
5. separating said second slurry into a second aqueous solvent solution and vinyl halide polymers, and
6. dehydrating each of said aqueous solvent solutions and recovering the solvent for reuse in solvent cleaning.

14. The process of claim 13 wherein said first slurry from step (1) is cooled to a temperature in the range of 30° to 65° C.

15. The process of claim 14 wherein said steam contains 0.1 to 60% by weight of entrained water.

16. The process of claim 15 wherein said solvent is dimethyl formamide.

17. The process of claim 13 wherein the contents of the vessel is agitated throughout step (1) at a sufficient speed so that the vinyl halide polymers that have precipitated from said solution remain as discrete, easily separable particles.

* * * * *